US006087985A

United States Patent [19]

Rümmeli et al.

[11] Patent Number: 6,087,985

[45] Date of Patent: Jul. 11, 2000

[54] TRACKING SYSTEM

[75] Inventors: Bernd Rümmeli, Strande, Germany; Brian Scott, Great Yarmouth, United Kingdom

[73] Assignee: RR Elektronische Gerät GmbH & Co. KG, Kiel, Germany

[21] Appl. No.: 09/172,344

[22] Filed: Oct. 14, 1998

[30] Foreign Application Priority Data

Oct. 14, 1997 [DE] Germany ..... 197 45 159
Nov. 19, 1997 [DE] Germany ..... 197 57 992

[51] Int. Cl.[7] ..... H01Q 3/00

[52] U.S. Cl. ..... 342/359; 342/78; 342/425; 343/757; 343/78 CA

[58] Field of Search ..... 342/74–75, 77–78, 342/359, 425; 343/757, 779, 775, 832, 912, 781 CA

[56] References Cited

U.S. PATENT DOCUMENTS 3,866,233 2/1975 Schmidt ..... 343/761
4,010,472 3/1977 Mountcastle et al. ..... 343/761
4,156,241 5/1979 Mobley et al. ..... 343/100 ST
4,305,075 12/1981 Salvat et al. ..... 343/7.4
5,130,718 7/1992 Wu et al. ..... 343/781 CA
5,351,060 9/1994 Bayne ..... 343/766
5,457,464 10/1995 Scott et al. ..... 342/352

*Primary Examiner*—Thomas H. Tarcza
*Assistant Examiner*—Dao L. Pham
*Attorney, Agent, or Firm*—Henry M. Feiereisen

[57] ABSTRACT

A tracking system for maintaining an alignment between a reflector antenna and a source of electromagnetic radiation, includes a reflector for reflecting electromagnetic radiation generated from a electromagnetic radiation source, a receiver, and a rotary sub-reflector which is positioned in front of the reflector for deflecting the radiation reflected by the reflector to the receiver and for generating triggering signals for measuring the strength of signals of the reflected radiation, whereby the sub-reflector is arranged at an inclination with respect to the reflector by an offset angle.

44 Claims, 4 Drawing Sheets

TRACKING SYSTEM

CROSS-REFERENCES TO RELATED APPLICATIONS

This application claims the priority of German Patent Applications, Serial No. 197 45 159.4, filed Oct. 14, 1997, and Serial No. 197 57 992.2, filed Nov. 19, 1997.

BACKGROUND OF THE INVENTION

The present invention relates to a method and apparatus for maintaining an alignment between a reflector antenna and a source of electromagnetic radiation, and more particularly relates to a tracking system of a type having a reflector for reflecting electromagnetic radiation generated from a electromagnetic radiation source, a receiver, and a rotary sub-reflector positioned between the reflector and the radiation source for directing the radiation reflected by the reflector to the receiver and for generating triggering signals to provide a reading of the reflected radiation.

U.S. Pat. No. 5,457,464, issued on Oct. 10, 1995, discloses such a tracking system for monitoring alignment between a reflector antenna and a source of electromagnetic radiation. Arranged between the radiation source and the reflector of the reflector antenna is a rotatable sub-reflector which extends transversely to the longitudinal axis of the reflector for directing radiation reflected by the reflector onto a receiving element. The sub-reflector is formed as interrupter or attenuator, and includes one or more eccentric, radially opposing apertures for interrupting or attenuating regions of the radiation reflected by the reflector. The interrupter is formed by a pair of reflective disks, with each of the disks having formed therein the apertures. At a misalignment of the reflector, portions of the radiation are interrupted or attenuated by coinciding apertures and thus have different radiation strength or measuring signals. The chosen measuring signals are stored and compared in a comparator to generate a corrective signal for operating motors by which the reflector is then re-aligned.

This conventional tracking system has the drawback that the sub-reflector or interrupter is relatively complex and that the tracking system can only attenuate received signals. Moreover, this conventional tracking system requires the use of a so-called orthomode transducer which has an offset of about 90 degrees or two receiving elements which are arranged at a right angle to one another to correct a rotary phase misalignment.

SUMMARY OF THE INVENTION

It is thus an object of the present invention to provide an improved tracking system, obviating the afore-stated drawbacks.

In particular, it is an object of the present invention to provide an improved tracking system which is of simple structure and permits realization of more favorable measuring signals.

These objects, and others which will become apparent hereinafter, are attained in accordance with the present invention by providing a sub-reflector which is inclined with respect to the reflector by an offset angle.

Through the inclination of the sub-reflector about an offset angle, the need for an interrupter or attenuator is eliminated so that the configuration of the sub-reflector is simplified. The inclination of the sub-reflector causes the radiation reflected by the sub-reflector during rotation thereof to travel along a predetermined transmission path.

When the main beam or the reflector faces away from the radiation source, the measuring signals are attenuated; However, when the main beam or the reflector are tilted in the direction of the radiation source, the measuring signals are increased. Thus, improved corrective signals for re-aligning the reflector are produced.

Preferably, the reflector is shaped as a segment of a paraboloid, and the sub-reflector is of convex shape on its side facing the reflector. The receiver is suitably arranged on the radiation source distal backside of the reflector. Preferably, a guide tube is positioned between the sub-reflector and the receiver for conducting the radiation reflected by the reflector to the receiver, with the reflector antenna corresponding in modified form essentally a Cassegrain type antenna.

According to another feature of the present invention, a magnetic polarotor is positioned between the sub-reflector and the receiver, with the polarotor being formed as a coil excited by alternating voltage for influencing the radiation between the sub-reflector and the receiver. The polarotor can generate two triggering signals which can be utilized to sense and store readings commensurate with the strength of signals and compared to one another. This enables a simple and secure generation of required triggering signals.

Preferably, the reflector antenna is connected for signal transmission to a first coaxial cable extending vertically towards attachment to a bottom portion of the reflector antenna, and to a second coaxial cable extending vertically towards attachment to a top portion of the reflector antenna. By being disposed in this manner, both coaxial cables are prevented from mechanicaly impacting one another when the reflector antenna is rotated. Also, the provision of two coaxial cables allows transmission of horizontal and vertical signals transmitted from a low-noise block converter, which is arranged at the reflector, along separate coaxial cables, i.e. horizontal signals can be transmitted in one of the coaxial cable and horizontal signals can be transmitted in the other one of the coaxial cables. Suitably, the second coaxial cable is guided via a radome which spans over the reflector antenna. However, the second coaxial cable may also be guided via other mechanical mountings, e.g. a bracket.

A guiding of the coaxial cables to the reflector antenna from different directions reliably eliminates a mutual impact of both coaxial cables, e.g. tangling up and eventual tearing during pivoting of the reflector antenna.

According to another feature of the present invention, a bracket is positioned between the radome and the reflector antenna for guiding the second coaxial cable, whereby a first end of the second coaxial cable is connectable to the reflector antenna and a second end is rotatably connected to a coaxial line flanking an antenna-proximate inner side of the radome. Through the provision of the bracket, the second coaxial cable is properly guided and held in a defined position with respect to the reflector antenna and the first coaxial cable. In addition, the bracket realizes a strain relief of the coaxial cable. Thus, the second coaxial cable can be rotated together with the reflector antenna without restrictions. Attachment of such distinct coaxial cables from opposite directions is principally applicable in all revolving antennas which are spanned by a radome or other auxiliary means, e.g. bracket.

Preferably, the supply of current to the reflector antenna, in particular the electronic control mechanism and the control motors, is realized between a stationary antenna platform and a revolving antenna base via a transformer which has fixed primary windings and rotatable secondary windings arranged in opposition to the primary windings. The provision of a transformer with rotating secondary windings in opposition to static primary windings permits a safe and trouble-free, contactless current transmission and does not rely on sliprings. This, the current transmission is practically maintenance-free.

According to another feature of the present invention, the reflector antenna and the tracking system can be arranged on a vehicle, e.g. a ship, whereby misalignments of the reflector antenna as a result of rough sea can be corrected rapidly and safely by the tracking system according to the present invention.

The conventional tracking system according to U.S. Pat. No. 5,457,464 permits merely an attenuation of the measuring signals during rotation of the sub-reflector. However, the rotation does not have any impact on the direction of radiation deflection or on the main beam of the reflected radiation.

It is thus a further object of the present invention to provide an improved method for aligning a tiltable reflector antenna to a source of electromagnetic radiation, which enhances the quality of measuring signals and impacts the rotation of the sub-reflector as well as the main beam of radiation.

This object is attained in accordance with the present invention by deflecting radiation signals, which are generated from a radiation source and reflected by a reflector onto a sub-reflector for reflection onto a receiver, along a predetermined path as a consequence of an inclination of the sub-reflector with respect to the reflector, when the sub-reflector is rotated.

Through deflection of the radiation reflected by the sub-reflector, and thus deflection of the main beam of radiation, a misalignment of the main beam, i.e. a skewed disposition with respect to the radiation source, results in an attenuation of the measuring signals while an inclination of the main beam in direction of the radiation source results in an increase of the measuring signals, thereby realizing enhanced corrective signals.

Preferably, radiation signals are transmitted from the reflector antenna via at least two coaxial cables extending from the reflector antenna in two separate directions. By transmitting the signals through coaxial cables which are directed away from the reflector axis in separate directions, the signals in the coaxial cables are prevented from influencing each other, and the coaxial cables are prevented from mechanically impacting each other.

According to a further feature of the present invention, the current supply of the reflector antenna is realized via a transformer having secondary windings revolving with respect to stationary primary windings. The provision of a transformer with revolving secondary windings effects a simple, trouble-free and practically maintenance-free current supply of the reflector antenna.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
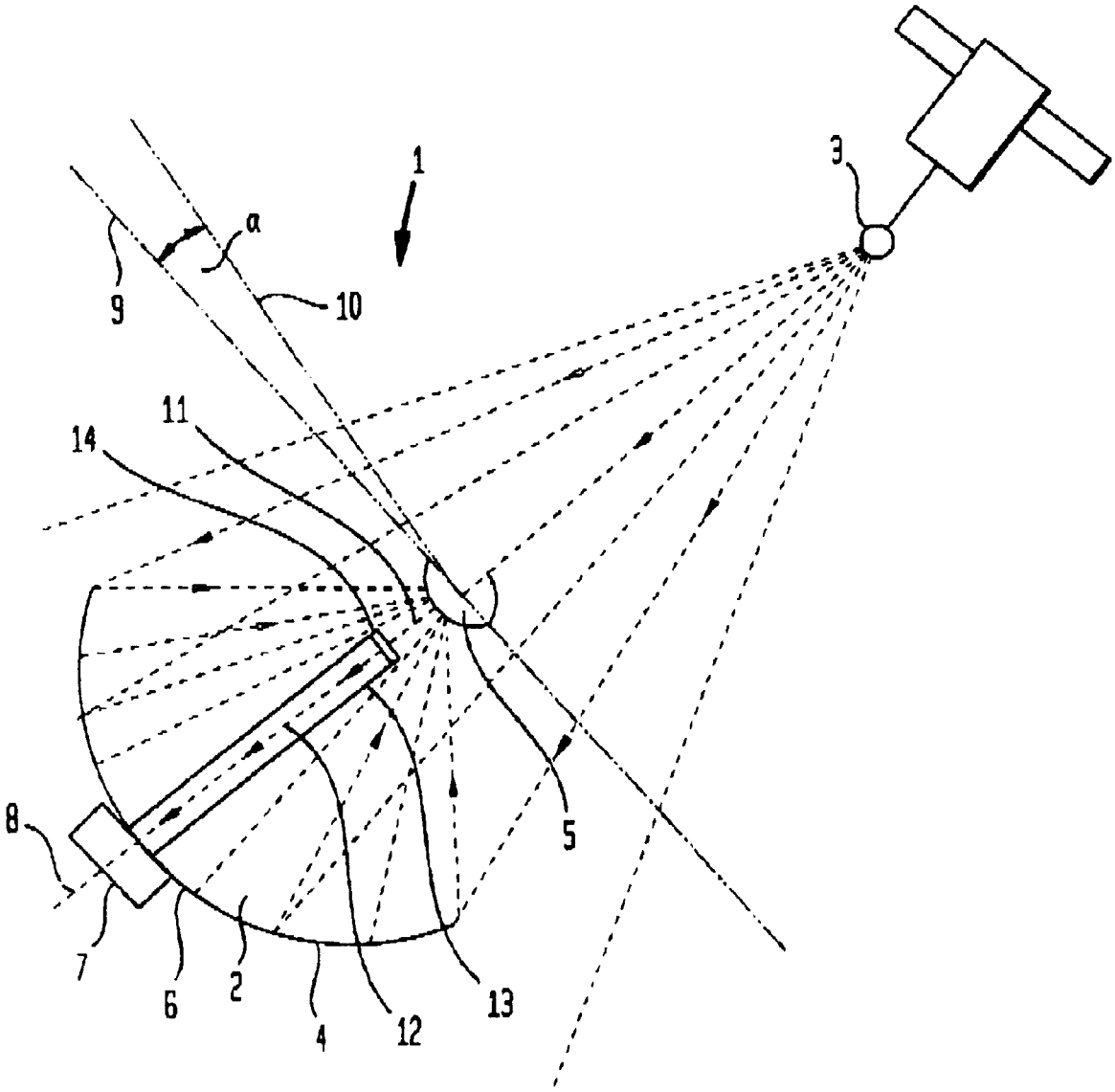
FIG. 1 is a schematic side view of one embodiment of a tracking system according to the present invention for monitoring alignment between a transmitting satellite as a radiation source and a reflector antenna.

Turning now to the drawing, and in particular to FIG. 1, there is shown a schematic side view of one embodiment of a tracking system according to the present invention, generally designated by reference numeral 1 for monitoring alignment between a reflector antenna or dish, generally designated by reference numeral 2, and a source 3 of electromagnetic radiation signals, e.g. a transmitter of a TV satellite or a navigation satellite. The reflector antenna 2 which may be mounted on a vehicle, e.g. a ship, essentially includes a parabolic reflector 4 which defines a longitudinal axis 8 and focuses the signals received from the radiation source 3, and a sub-reflector 5 which is rotatably mounted in direction toward the radiation source 3 in front of the reflector 4 for deflecting radiation reflected by the reflector 4 to a receiving element 7 which is secured centrally at the source-distal backside of the reflector 4. Arranged between the receiving element 7 and the sub-reflector 5 is a tube 13 for guiding the radiation deflected by the sub-reflector 5 in the form of a main beam 12 to the receiving element 7.

Persons skilled in the art will understand that the reflector may certainly have a configuration other than the parabolic configuration, e.g. a flat configuration. The side of the sub-reflector 5 facing the reflector 4 is convexly shaped, whereby the shape of the sub-reflector 5 is suitably selected in dependence on the shape of the reflector 4.

As shown in FIG. 1, the sub-reflector 5 is so mounted that its axis 10 defines with a vertical line 9 applied upon the longitudinal axis 8 of the reflector 4 an offset-angle $\alpha$, i.e. the sub-reflector 5 is tilted with respect to the reflector 4. A motor (not shown) rotates the sub-reflector 5 about an axis 11.

Positioned between the sub-reflector 5 and the receiving element 7 is a polarotor 14 which is formed by a coil. Upon applying alternating voltage, the polarotor 14 influences the radiation between the sub-reflector 5 and the receiving element 7 by tilting the incident radiation by about 5° with respect to the longitudinal axis 8. The polarotor 14 generates two triggering signals which can be used to sense and store readings of the strength of the signal deflected by the sub-reflector 5 in direction of the receiving element 1.

Figure 2:
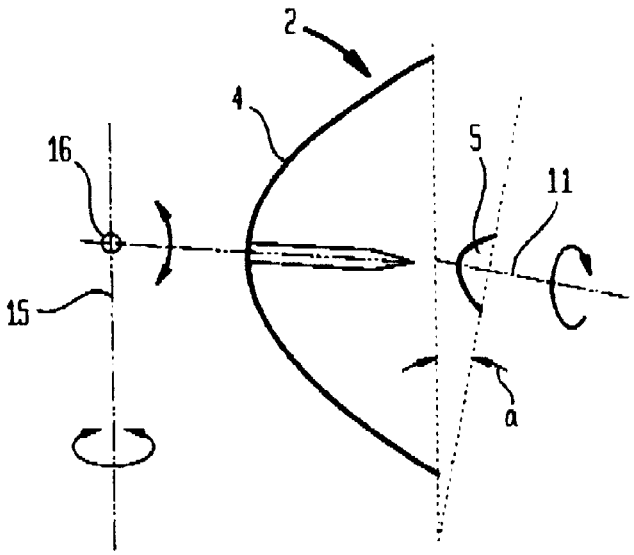
FIG. 2 is a schematic cutaway view of the reflector antenna, showing in detail a reflector with sub-reflector.
Figure 3:
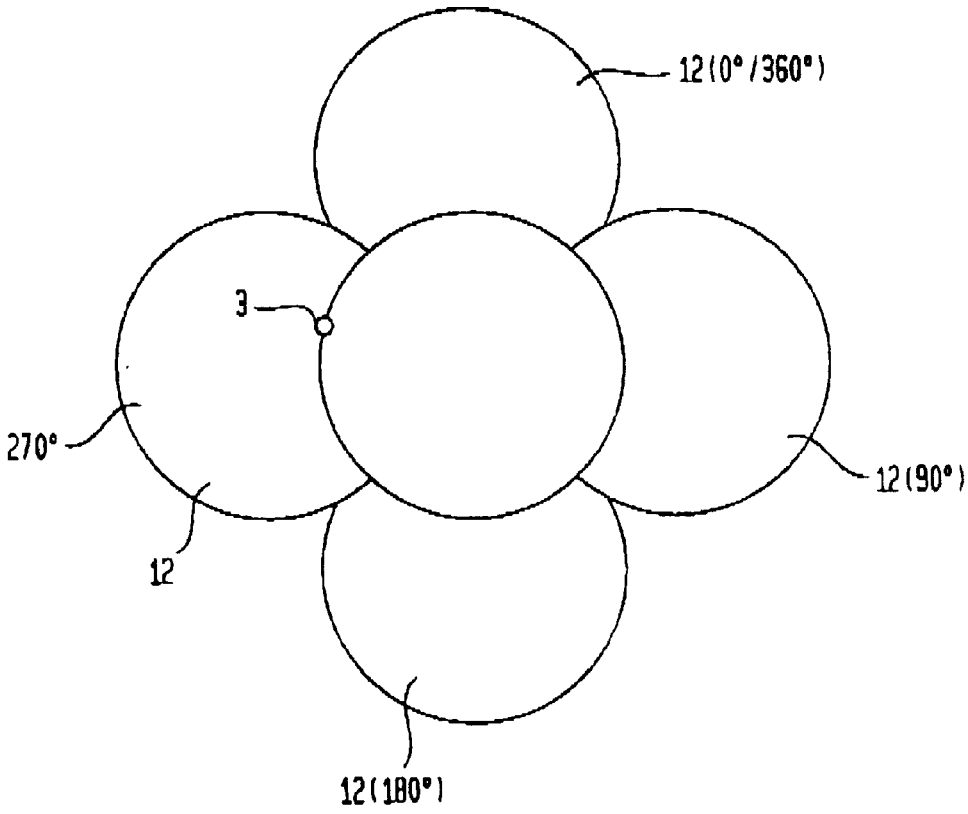
FIG. 3 is a schematic illustration of the deflection of the main beam of radiation by the sub-reflector in four different positions of the sub-reflector.

The operating principle of the tracking system according to the present invention will now be described. Electromagnetic radiation transmitted from the radiation source 3, e.g. TV satellite or navigation satellite, impinges approximately parallel on the reflector 4 which reflects the radiation in direction of the sub-reflector 5 from where the radiation is deflected through the tube 13 toward the receiving element 7. The sub-reflector 5 is rotated to generate four triggering signals offset by 90° for measuring the signal strength of the main beam 12, as shown in FIG. 3. As a consequence of the tilted disposition of the sub-reflector 5 with respect to the reflector 4 by the offset-angle $\alpha$, a rotation of the sub-reflector causes a deflection of the main beam 12 which propagates along a predetermined path. A sensor of the receiving element 7 measures the signal strength, and the respective readings and the readings from the polarotor 14 are stored and compared by a comparator (not shown) of a control unit (not shown) to produce a corrective signal for operating a corrective mechanism to swivel and realign the reflector antenna 2 with respect to the radiation source 3. The corrective mechanism may suitably include a plurality of motors, e.g. stepper motors, whereby, as shown in FIG. 2, a first motor is provided to realize a pivoting of the reflector antenna 2 about a vertical axis 15 while a second motor effects a pivoting of the reflector antenna 2 about a horizontal axis 16. Suitably, the reflector antenna 2 and the corrective mechanism may be operatively connected to a compass by which control signals can be generated for compensating a directional change of the vehicle.

The reflector antenna 2 may additionally operatively connected to a PC (not shown) or display for indicating the signal readings and received TV images.

Figure 4:
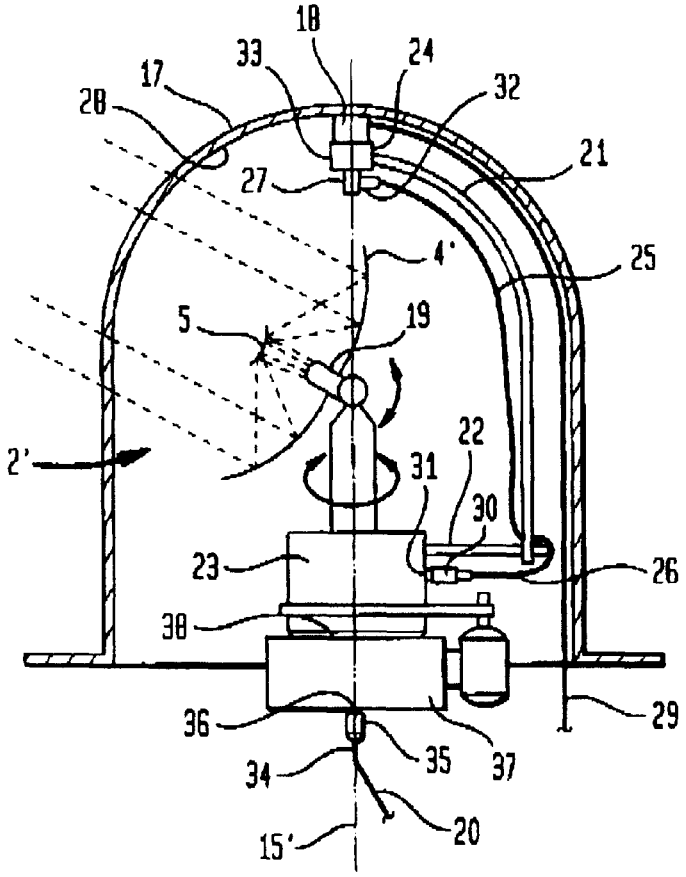
FIG. 4 is a schematic side view of another embodiment of a tracking system according to the present invention for monitoring alignment between a radiation source and a reflector antenna, with the reflector antenna being housed in a radome.

Turning now to FIG. 4, there is shown a schematic side view of another embodiment of a tracking system according to the present invention for monitoring alignment between a radiation source (not shown) and a reflector antenna, generally designated by reference numeral 2'. The reflector antenna 2' is housed in a radome 17 which spans over the reflector antenna 2' and is made of plastic that is transparent to electromagnetic radiation. The apex 18 of the radome 17 is positioned approximately in the prolongation of the vertical pivot axis 15' of the reflector antenna 2'.

The reflector antenna 2' includes a parabolic reflector 4' which reflects incident radiation to a sub-reflector 5' (shown only schematically). A converter, a so-called low-noise block converter 19 or LNB is mounted to the backside of the reflector 4' to serve as the receiving element and includes a first output 36 arranged on the antenna base 23 and a second output 31 arranged on the antenna base 23. The reflector 4' is mounted on the antenna base 23 which is rotatably secured on a stationary platform 37.

Transmission of the signal is realized through a first coaxial cable 20 which is connected in vertical extension to the output 36 of the reflector antenna 2'. Arranged inside the radome 17 is a bracket 21 which has one end 22 connected to the antenna base 23, and an opposite end 24 rotatably attached to the radome 17 at the apex 18. The coaxial cable 20 has one end 34 which is connected to the first output 36 of the low-noise block converter 19 via a plug-and-socket connection 35 in the form of a revolving joint.

A second coaxial cable 25 extends along the bracket 21 and has one end 26 which extends radially to the vertical pivot axis 15' and is operatively connected to the second output 31 of the low-noise block converter 19 via a plug-and-socket connection 30. The other end 27 of the coaxial cable 25 is rotatably secured via a plug-and-socket connection to a coaxial line 29 which straddles along the antenna-facing inside wall 28 of the radome 17, whereby the plug-and-socket connection is formed for example by a SMB plug secured to the cable end 27 for pivoted attachment to a complementary member 33 in the form of a SMB socket which is securely fixed to the inside of the radome 17.

Figure 5:
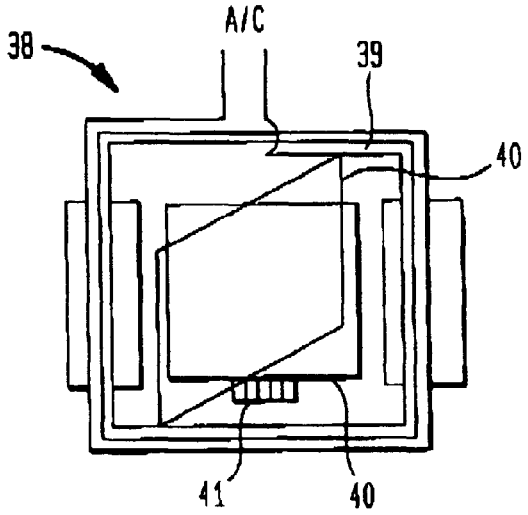
FIG. 5 is a schematic illustration of a transformer for realizing a current supply for the reflector antenna of FIG. 4.

The current transmission between the stationary antenna platform 37 and the rotatable antenna base 23 is realized via a transformer 38. As shown in FIG. 5, the transformer has static primary windings 39 and secondary windings 40 which are rotatable with respect to the primary windings 39. This kind of current transmission is principally applicable for all types of rotating antennas. 23 The transformer 38 corresponds in principle the configuration of an electromotor without carbon brushes, with the primary windings 39 corresponding to the field winding of the electromotor, and with the secondary windings 40 of the transformer 38 corresponding to the rotating windings of the electromotor and joined together via bridge rectifiers 42 to realize a common current supply, as shown in FIG. 8. A commutator-like component 41 corresponds to the commutator of the electromotor, with the secondary windings 40 being connected to the terminals of the commutator, as shown in FIG. 7.

Figure 6:
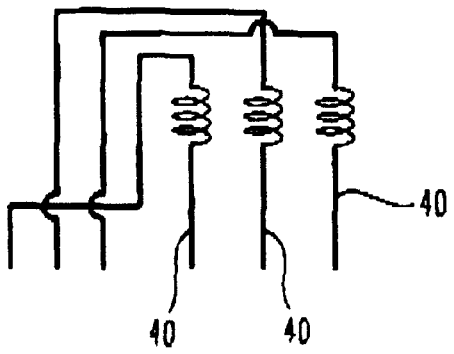
FIG. 6 is a schematic illustration of the transformer with three secondary windings.
Figure 7:
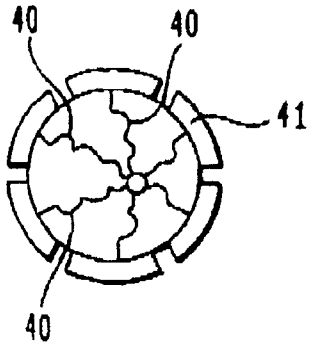
FIG. 7 is a schematic illustration of the connection of the secondary windings of the transformer of FIG. 6 to a commutator-like component.
Figure 8:
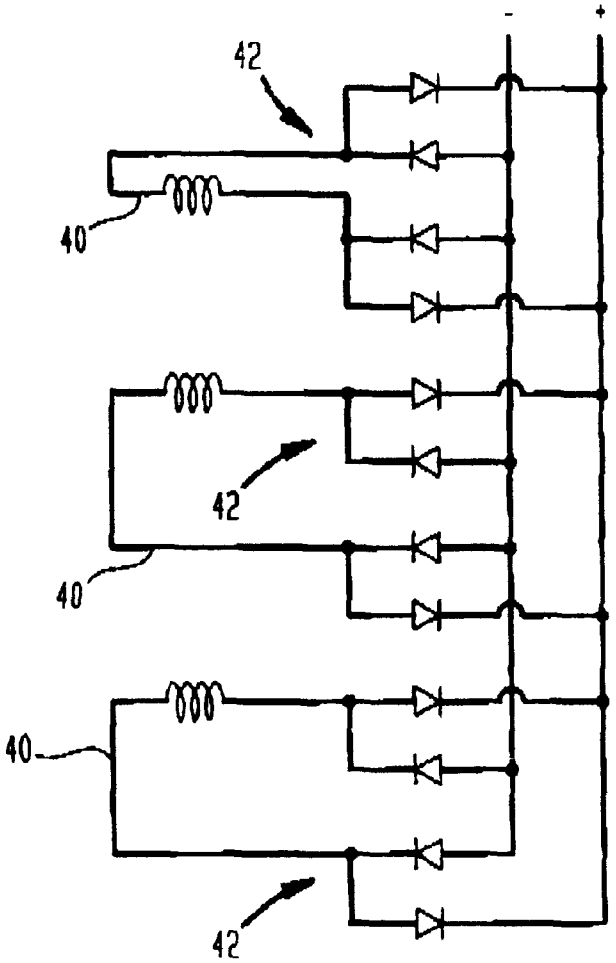
FIG. 8 is a circuit diagram of the secondary windings of the transformer of FIG. 6 with connected rectifier diodes in a bridge circuit.

The transformer 38 may include e.g. 18 secondary windings 40, three of which are shown in FIGS. 6 to 8. Only the one of the secondary windings 40 is in operation at one time which has its winding extending approximately perpendicular to the primary winding 39 or field winding. The magnetic field is at a maximum for this winding. The other secondary windings 40 generate at this time less or no voltage. Connected to all secondary windings 40 are the bridge rectifiers 42 by which the secondary windings 40 are united to realize a common current supply.

The secondary windings 40 are connected to a lower portion of the commutator-like component 41, with both ends of each winding connected on opposite sides of the component 41, as shown in FIG. 7.

Persons skilled in the art will understand that it is certainly also possible to supply the reflector antenna via sliprings (not shown).

The signal transmission from the reflector antenna 2' is realized via the two coaxial cables 20, 25 along two distinct directions, whereby vertical and horizontal signals of the low-noise block converter 19 are conducted in the separate coaxial cables 20, 25. A rotation of the reflector antenna 2' about the vertical axis 15' conjointly revolves the secondary windings 40, while the primary windings 38 remain stationary so that the current transmission and power supply between the stationary platform 37 and the rotatable antenna base 23 is realized free of contacts by transformation of the power supply via the transformer 38.

While the invention has been illustrated and described as embodied in a tracking system, it is not intended to be limited to the details shown since various modifications and structural changes may be made without departing in any way from the spirit of the present invention.

What is claimed as new and desired to be protected by Letters Patent is set forth in the appended claims:

1. A motorized reflector antenna that maintains alignment to a source of electromagnetic radiation, comprising:

a main reflector for reflecting the electromagnetic radiation being generated by the source;

a receiver;

a rotatable sub-reflector arranged at an inclination with respect to the reflector by an offset angle and positioned in front of the main reflector on a symmetry axis of the main reflector for re-directing the radiation reflected by the main reflector to the receiver in response to the rotation of the sub-reflector, and a magnetic polarotor positioned between the sub-reflector and the receiver, said sub-reflector generating triggering signals for a measurement of a signal strength of the reflected radiation, wherein said signal strength produces a corrective signal for maintaining alignment of the main antenna with the source.

2. The motorized reflector antenna of claim 1, wherein the reflector is shaped as a segment of a paraboloid.

3. The motorized reflector antenna of claim 1, wherein the sub-reflector is flat.

4. The motorized reflector antenna of claim 1, wherein the sub-reflector has a convex shape.

5. The motorized reflector antenna of claim 4, wherein the sub-reflector has a parabolic shape.

6. The motorized reflector antenna of claim 4, wherein the sub-reflector has a hyperbolic shape.

7. The motorized reflector antenna of claim 1, and further comprising a tube positioned between the sub-reflector and the receiver for guiding the radiation reflected by the sub-reflector to the receiver.

8. The motorized reflector antenna of claim 1, wherein the reflector has a source-distal backside, said receiver being disposed on the backside of the reflector.

9. The motorized reflector antenna of claim 1, wherein the polarotor is formed as a coil excited by alternating voltage for influencing the radiation between the sub-reflector and the receiver.

10. The motorized reflector antenna of claim 9, wherein radiation received by the polarotor is tilted by about 5°.

11. The motorized reflector antenna of claim 1, wherein the polarotor generates two triggering signals in response to the alternating voltage which are used for sensing and storing readings of the signal strength.

12. The motorized reflector antenna of claim 1, wherein the radiation source is formed as a transmitter of a television satellite.

13. The motorized reflector antenna of claim 1, wherein the radiation source is formed as a transmitter of a navigation satellite.

14. The motorized reflector antenna of claim 1, wherein the reflector antenna is positioned on a vehicle.

15. The motorized reflector antenna of claim 14 wherein the vehicle is a ship.

16. The motorized reflector antenna of claim 1, and further comprising a display operatively connected to the reflector antenna.

17. The motorized reflector antenna of claim 1, and further comprising a swiveling device operatively connected to the reflector antenna.

18. The motorized reflector antenna of claim 12, and further comprising means for simultaneous display of signal readings and received television images.

19. The motorized reflector antenna of claim 1, wherein the reflector antenna has incorporated therein corrective mechanism for swiveling the reflector antenna.

20. The motorized reflector antenna of claim 19, wherein the corrective mechanism includes a first motor for rotating the reflector antenna about a vertical axis, and a second motor for rotating the reflector antenna about a horizontal axis.

21. The motorized reflector antenna of claim 20, wherein the first and second motors are controllable by control. signals obtained through the measurement of the signal strength.

22. The motorized reflector antenna of claim 14, and further comprising a compass connected to the reflector antenna for generating control signals for correcting a directional change of the vehicle.

23. The motorized reflector antenna of claim 1, wherein the reflector antenna has a first coaxial cable and a. second coaxial cable for transmission of signals, said first coaxial cable extending vertically for connection to a bottom portion of the reflector antenna, and said second coaxial cable extending vertically for connection to a top portion of the reflector antenna.

24. The motorized reflector antenna of claim 23, and further comprising a radome spanning over the reflector antenna, said second coaxial cable extending to the reflector antenna via the radome.

25. The motorized reflector antenna of claim 24, and further comprising a bracket positioned between the radome and the reflector antenna for guiding the second coaxial cable, said bracket having a first end connectable to the reflector antenna and a second end rotatably connected to the radome.

26. The motorized reflector antenna of claim 25, and further comprising a rotatable base for the reflector antenna, said second coaxial cable having a first antenna-proximal end which is connected to the base approximately radially to a vertical axis.

27. The motorized reflector antenna of claim 26, wherein the second coaxial cable has a second antenna-distal end rotatably connected to a coaxial line extending downwardly along an antenna-proximate inner side of the radome.

28. The motorized reflector antenna of claim 26, and further comprising a low-noise block converter having a first output arranged at the rotatable base and a second output arranged at the rotatable base, said first end of the second coaxial cable being connected to the second output of the block converter via a plug-and-socket connection.

29. The motorized reflector antenna of claim 27, wherein the second end of the second coaxial cable has a connector element rotatably secured to a complementary stationary connector element which is securely fixed to the radome and attached to one end of the coaxial line.

30. The motorized reflector antenna of claim 29, wherein the connector element of the second coaxial cable is a SMB plug, and the complementary stationary connector element is a SMB socket.

31. The motorized reflector antenna of claim 28, wherein the first coaxial cable has a first end connected to the first output of the low-noise back converter via a plug-and-socket connection.

32. The motorized reflector antenna of claim 31, wherein the plug-and-socket connection is formed as revolving joint.

33. The motorized reflector antenna of claim 26, wherein the rotatable antenna base is rotatably mounted on a stationary antenna platform.

34. The motorized reflector antenna of claim 33, and further comprising sliprings for realizing a current transmission for supply of the reflector antenna between the stationary antenna platform and the rotatable antenna base.

35. The motorized reflector antenna of claim 33, and further comprising a transformer for realizing a current transmission for supply of the reflector antenna between the stationary antenna platform and the rotatable antenna base, said transformer having fixed primary windings and rotary secondary windings which are arranged in opposition to the primary windings.

36. The motorized reflector antenna of claim 35, wherein the primary windings correspond to field windings of an electromotor.

37. The motorized reflector antenna of claim 35, wherein the secondary windings correspond to rotating windings of an electromotor and are united to a common current supply via bridge rectifiers.

38. The motorized reflector antenna of claim 37, wherein the secondary windings have outputs which are coupled via rectifier diodes.

39. A method for aligning a motorized reflector antenna to a source of electromagnetic radiation, comprising the steps of:

directing radiation signals generated from a radiation source and reflected by a main reflector onto a sub-reflector for deflection of the radiation onto a receiver along a predetermined path responsive to an inclination of the sub-reflector with respect to the main reflector, when the sub-reflector is rotated;

producing triggering signals, in response to predetermined angular rotations of the sub-reflector for measuring the strength of the signal reflected from the sub-reflector;

storing the measured signal strength determined at the predetermined angular rotations; and comparing the signal strength determined at different ones of the predetermined angular rotations of the sub-reflector for producing a corrective signal to control motors for pivoting the reflector antenna.

40. The method of claim 39 wherein the signal strength of the radiation reflected by the sub-reflector is attenuated at a misalignment of the reflector and increased during correction of the misalignment of the reflector.

41. The method of claim 39, and further comprising the step of transmitting radiation signals from the reflector antenna via at least two coaxial cables which extend from the reflector antenna in two separate directions.

42. The method of claim 41, and further comprising the step of directing vertical and horizontal signals of a low-noise block converter along the coaxial cables in the separate directions.

43. The method of claim 39, and further comprising the step of supplying a current to the antenna via sliprings.

44. The method of claim 39, and further comprising the step of providing the current supply of the reflector antenna via a transformer having secondary windings revolving with respect to stationary primary windings.

* * * * *